US005909003A

United States Patent [19]

Burri

[11] Patent Number: 5,909,003

[45] Date of Patent: Jun. 1, 1999

[54] PROJECTILE ROTATING BAND

[75] Inventor: Jakob Burri, Regensdorf, Switzerland

[73] Assignee: Oerlikon Contraves Pyrotec AG, Zürich, Switzerland

[21] Appl. No.: 08/944,838

[22] Filed: Oct. 6, 1997

[30] Foreign Application Priority Data

Jan. 13, 1997 [CH] Switzerland ..... 58/97

[51] Int. Cl.[6] ..... F42B 12/00; F42B 14/02

[52] U.S. Cl. ..... 102/518; 102/526; 29/1.23

[58] Field of Search ..... 102/501, 514–527, 102/528, 529; 86/1.1; 29/1.2–1.23

[56] References Cited

U.S. PATENT DOCUMENTS

| | | | |
|---|---|---|---|
| 3,910,194 | 10/1975 | Dehm et al. | 102/527 |
| 4,520,731 | 6/1985 | Gotz et al. | 102/527 |
| 4,558,646 | 12/1985 | Hoffmann et al. | 102/527 |
| 4,779,536 | 10/1988 | Luther et al. . | |
| 4,833,995 | 5/1989 | Götz et al. . | |

FOREIGN PATENT DOCUMENTS

| | | |
|---|---|---|
| 2758692 | 7/1979 | Germany . |
| 3736167 | 5/1989 | Germany . |
| 2251480 | 7/1992 | United Kingdom . |

*Primary Examiner*—Harold J. Tudor
*Attorney, Agent, or Firm*—Browdy and Neimark

[57] ABSTRACT

A projectile rotating band (7) is firmly connected, through openings (9) in the projectile casing (2), to a sealing section (10) at the rear of the projectile inside the projectile casing (2). The rotating band (7) is formed together with the sealing section (10) in the course of a single step of the manufacturing process by injecting a synthetic material into the projectile casing (2) through its open back. The band (7) is prevented from twisting off during firing by the unitary construction, and will not abrade the barrel since it is non-metallic.

6 Claims, 1 Drawing Sheet

PROJECTILE ROTATING BAND

FIELD OF THE INVENTION

The invention pertains to a projectile rotating band which is housed inside a circumferential recess on the projectile casing.

REVIEW OF THE RELATED TECHNOLOGY

The purpose of these rotating bands is to guide the projectile inside the barrel when it is discharged and cause it to rotate (spin) around the longitudinal axis. Rotating bands of this type, which are generally made of metallic materials, are known, for example, from DE-OS 37 36 167 or DE-OS 35 08 053. Rotating bands of this type have the disadvantage that they can cause a significant erosion of the bore. This premature erosion of the bore may be prevented if a suitable synthetic material is selected for the rotating bands, however, the manufacture, assembly and installation of rotating bands of this type is relatively complicated and expensive. From DE-OS 35 25 854, a similar rotating band is known, which is formed of two half-rings that can be securely fastened to each other with a snap-on lock. However, this rotating band is not firmly attached to the projectile casing but merely placed over the same in a manner which allows it to slide through, with the result that the projectile only receives a residual twist when it is discharged.

SUMMARY OF THE INVENTION

It is the object of the invention to present a rotating band of the above type which is devoid of the above-mentioned drawbacks.

In the present invention the rotating band is firmly connected, through openings in the projectile casing, to a sealing section at the rear of the projectile inside the projectile casing. The rotating band is formed together with the sealing section in a single step of the manufacturing process by injecting a synthetic material into the projectile casing through its open back.

The rotating band according to the invention presents the advantages that the rotating band is manufactured in a simple process and firmly and securely attached to the projectile casing, resulting in only minimal manufacturing costs.

BRIEF DESCRIPTION OF THE DRAWING

The above and other objects and the nature and advantages of the present invention will become more apparent from the following detailed description of an embodiment taken in conjunction with drawings, wherein.

DETAILED DESCRIPTION OF THE PREFERRED EMBODIMENT

Figure 1:
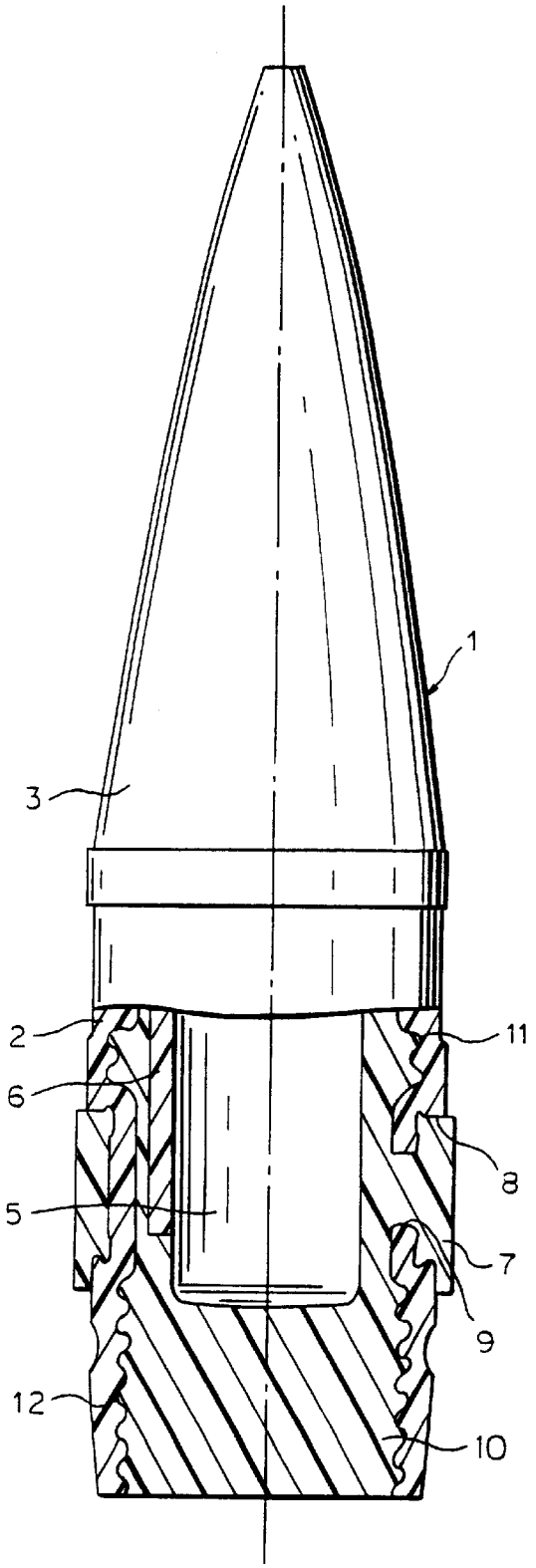
FIG. 1 is a cross-sectional view on a longitudinal section through a portion of the projectile cut by two intersecting planes meeting along the axis.
Figure 2:
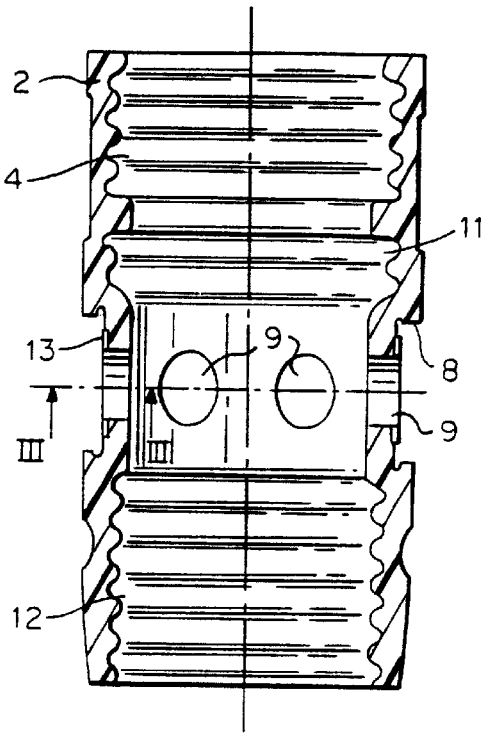
FIG. 2 is a view similar to that of FIG. 1 but showing only the projectile casing (also shown in FIG. 1)
Figure 3:
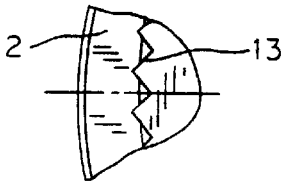
FIG. 3 is an partial enlarged cross-sectional view taken at the line III—III in FIG. 2, through a portion of the projectile casing.

In FIG. 1 through 3, the reference number 1 denotes a jacket, formed by a projectile casing 2 and a nose 3 which is firmly connected to the projectile casing. The nose 3, which is preferably made of a high-temperature-, fiber reinforced, thermoplastic synthetic material, is sprayed onto the projectile casing 2 in a first step of the manufacturing process in a manner so that the nose 3 is anchored in grooves 4 on the inner wall of the projectile casing 2. The nose 3 has centering fingers 6, not shown in detail on the drawing, inside which a core 5 of the projectile is guided and held in place. The core 5 of the projectile is inserted, in a second step of the manufacturing process, through the open back of the projectile casing 2 into the centering fingers 6 of the nose 3. The reference number 7 denotes a rotating band embedded in a circumferential recess 8 of the projectile casing 2. The rotating band 7 is firmly connected, through openings 9 inside the projectile casing 2, to a sealing section 10 at the rear of the projectile which is disposed inside a sealing section space in the projectile casing 2. The openings 9 may consist, for example, of six borings arranged radially in the area of the circumferential recess 8 and offset by an angle of 60°. However, a different number of openings or different shapes are also possible.

The rotating band 7 is a unitary piece comprising an outer or band portion in the recess 8 and an inner sealing section portion in the sealing section space. These portions are continuous through the openings 9.

In a third step of the manufacturing process, the rotating band 7 and the sealing section 10 are formed simultaneously by injecting, through the open back of the projectile casing 2, the same synthetic material used to manufacture the nose 3. In the process, the injected material exits through the openings 9 in the projectile casing 2, into the circumferential recess 8 and the circumferential grooves 11 and 12 inside the projectile casing 2. The injected material furthermore encompasses the portion of the projectile core 5 which protrudes from the centering 6, thus firmly anchoring the projectile core 5 inside the projectile. As is seen in FIG. 1, optionally the injected material does not extend beyond the rear of the projectile, i.e. no portion of the sealing section 10 protrudes beyond a rear rim of the projectile casing 2. The circumferential recess 8 has teeth 13 which interlock with the rotating band 7, thus enhancing the spin of the projectile.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention. Thus the expressions "means to . . . " and "means for . . . " as may be found in the specification above and/or in the claims below, followed by a functional statement, are intended to define and cover whatever structural, physical, chemical or electrical element or structure may now or in the future exist for carrying out the recited function, whether or not precisely equivalent to the embodiment or embodiments disclosed in the specification above;. and it is intended that such expressions be given their broadest interpretation.

What is claimed is:

1. A projectile comprising:

a projectile casing (2) comprising a circumferential recess (8) including a plurality of openings (9) between the recess and an inside of the casing;

a projectile nose (3) comprising a fiber-reinforced, thermoplastic synthetic material extending from a front end of the casing;

a projectile core (5) disposed within the casing and the nose; and a distinct sealing section (10), comprising the same fiber-reinforced thermoplastic synthetic material, disposed at a rear of the projectile inside the projectile casing (2) around a rear portion of the projectile core (5); and a rotating band (7) being unitary with the sealing section (10) and being firmly connected to the sealing section (10) via the openings (9).

2. The projectile according to claim 1, wherein the rotating band (7) and the sealing portion (19) are formed together during a single manufacturing step by injecting the synthetic material into the projectile casing (2) through an open back at a rear end thereof.

3. The projectile according to claim 1, comprising a center centering finger (6) between the casing and the core.

4. The projectile according to claim 1, wherein the casing comprises circumferential grooves (4, 11, 12) on an inner surface thereof and the sealing section and the nose are anchored to the grooves.

5. A method of making a projectile, the method comprising:

providing a projectile casing (2) comprising a circumferential recess (8) including a plurality of openings (9) between the recess and an inside of the casing;

forming, from a fiber-reinforced, thermoplastic synthetic material, a projectile nose (3) extending from a front end of the casing;

placing a projectile core (5) within the casing and the formed nose; and forming, from the same fiber-reinforced, thermoplastic synthetic material, a distinct sealing section (10) at a rear of the projectile inside the projectile casing (2) around a rear portion of the projectile core (5), and a rotating band (7) being unitary with the sealing section (10) and being firmly connected to the sealing section (10) via the openings (9).

6. The method according to claim 5, comprising placing a centering finger (6) into the nose prior to placing a projectile core (5) within the casing.

* * * * *